US007077109B2

(12) United States Patent
Lee

(10) Patent No.: US 7,077,109 B2
(45) Date of Patent: Jul. 18, 2006

(54) FUEL PUMP ASSEMBLY FOR VEHICLE

(75) Inventor: Sung Won Lee, Hwaseong (KR)

(73) Assignee: Hyundai Motor Company and Kia Motors Corporation, Seoul (KR)

( * ) Notice: Subject to any disclaimer, the term of this patent is extended or adjusted under 35 U.S.C. 154(b) by 4 days.

(21) Appl. No.: 10/747,914

(22) Filed: Dec. 29, 2003

(65) Prior Publication Data

US 2005/0061300 A1 Mar. 24, 2005

(30) Foreign Application Priority Data

Sep. 19, 2003 (KR) ..... 10-2003-0065260

(51) Int. Cl.
*F02M 37/04* (2006.01)

(52) U.S. Cl. ..... 123/514; 123/509

(58) Field of Classification Search ..... 123/514, 123/509; 417/151, 198
See application file for complete search history.

(56) References Cited

U.S. PATENT DOCUMENTS 4,279,232 A * 7/1981 Schuster et al. ..... 123/516
4,503,885 A * 3/1985 Hall ..... 137/574
4,834,132 A * 5/1989 Sasaki et al. ..... 137/143
4,911,134 A * 3/1990 Olsson ..... 123/514
5,263,458 A * 11/1993 Fujino et al. ..... 123/514
5,289,810 A * 3/1994 Bauer et al. ..... 123/510
5,396,872 A * 3/1995 Ruger et al. ..... 123/514
5,564,397 A * 10/1996 Kleppner et al. ..... 123/514
5,692,479 A * 12/1997 Ford et al. ..... 123/514
5,791,317 A * 8/1998 Eck ..... 123/510
6,058,911 A * 5/2000 Hashimoto et al. ..... 123/514
6,098,600 A * 8/2000 Umetsu et al. ..... 123/514
6,123,511 A * 9/2000 Sertier ..... 417/87
6,273,131 B1 * 8/2001 Kleppner ..... 137/565.22
6,343,589 B1 * 2/2002 Talaski et al. ..... 123/514

FOREIGN PATENT DOCUMENTS

DE 41 23 367 A1 1/1993
DE 35 00 718 C2 9/1993
DE 43 36 062 C2 7/2002
DE 101 36 437 A1 2/2003
EP 1 008 745 B1 10/2002
JP 07-071334 3/1995

* cited by examiner

*Primary Examiner*—Thomas Moulis
(74) *Attorney, Agent, or Firm*—Morgan Lewis & Bockius LLP

(57) ABSTRACT

A fuel pump assembly mounted in a fuel tank for sending fuel to a fuel injector includes a driving means for supplying a driving force for sending or returning fuel, a reservoir for temporarily reserving fuel from the fuel tank through a check valve mounted on a bottom portion thereof, a first fuel suction device for drawing fuel reserved in the reservoir, a return pipe for returning fuel from the fuel injector to the reservoir, a second fuel suction device for drawing fuel stored in the fuel tank, and a Z-nozzle portion of which an outlet is connected to a bottom portion of the reservoir. The second fuel suction device and return pipe are connected to an inlet of the Z-nozzle portion.

6 Claims, 3 Drawing Sheets

FUEL PUMP ASSEMBLY FOR VEHICLE

CROSS-REFERENCE TO RELATED APPLICATIONS

This application claims priority of Korean Application No. 10-2003-0065260, filed on Sep. 19, 2003, the disclosure of which is incorporated fully herein by reference.

FIELD OF THE INVENTION

The present invention relates to a fuel pump assembly mounted in a fuel tank for sending fuel stored in the fuel tank to a fuel injector, and more particularly, to a fuel pump assembly for stably sending fuel to a fuel injector when the fuel level becomes low.

BACKGROUND OF THE INVENTION

Generally, a fuel pump assembly mounted in a fuel tank storing fuel comprises a fuel pump for sending fuel from the fuel tank to a fuel injector and returning fuel from the fuel injector to the fuel tank, and a reservoir mounted in the fuel tank for temporarily reserving fuel.

However, when a vehicle moves on an inclined road or a curved road, the fuel reserved in the fuel tank is driven to a corner of the fuel tank such that an additional fuel suction device driven by the fuel pump should be provided.

Accordingly, due to the additional suction device and a connecting means for connecting such device and the fuel tank assembly, the inner structure of the fuel tank become complicated such that it is difficult to assemble the fuel tank assembly.

SUMMARY OF THE INVENTION

An exemplary fuel pump assembly mounted in a fuel tank for sending fuel to a fuel injector according to an embodiment of the present invention includes a driving means for supplying a driving force for sending or returning fuel, a reservoir for temporarily reserving fuel from the fuel tank through a check valve mounted on the bottom portion thereof, a first fuel suction device for drawing fuel reserved in the reservoir, a return pipe for returning fuel from the fuel injector to the reservoir; a second fuel suction device for drawing fuel stored in the fuel tank, and a jet pump portion of which an outlet is connected to a bottom portion of the reservoir. The second fuel suction device and a return pipe are connected to an inlet of the jet pump portion.

Preferably, the second fuel suction device horizontally extends with respect to the fuel tank.

Preferably, the return pipe functions as an orifice such that the fuel in the fuel tank is drawn into the reservoir through the second fuel suction device.

Preferably, one end of the return pipe, which is connected to the jet pump portion, is bended to the direction of the reservoir.

Preferably, a first detent is formed on the bottom portion of the reservoir and a hook is formed on the jet pump portion such that the jet pump portion is fixed to the reservoir by a connection between the first detent and the hook.

Preferably, a hole is formed on the second fuel suction device and a second detent is formed on the jet pump portion such that the second fuel suction device is fixed to the jet pump portion by connection between the second detent and the hole.

Preferably, the connection between the second fuel suction device and the jet pump portion is sealed with thermal fusion.

Embodiments of the present invention provide a fuel pump assembly having non-limiting advantages of stable fuel supplying to the fuel injector with a simple structure for the case in which the fuel is driven to the corner of the fuel tank.

BRIEF DESCRIPTION OF THE DRAWINGS

The accompanying drawings, which are incorporated in and constitute a part of the specification, illustrates an embodiment of the invention, and together with the specification, serve to explain the principles of the invention.

DETAILED DESCRIPTION OF THE PREFERRED EMBODIMENTS

An embodiment of the present invention will hereinafter be described in detail with reference to the accompanying drawings.

Figure 1:
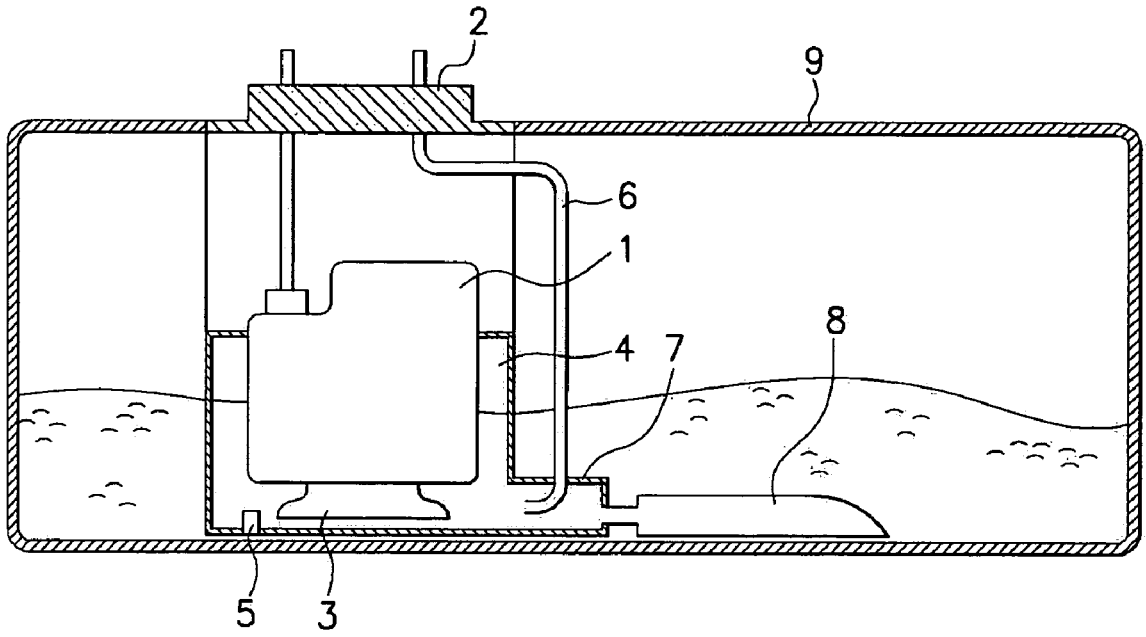
FIG. 1 is sectional view of a fuel pump assembly according to an embodiment of this invention.

As shown in FIG. 1, the fuel pump assembly 2 includes a driving means 1, a reservoir 4 mounted in a fuel tank 9, a first fuel suction device 3 for drawing fuel in the reservoir 4, a return pipe 6 for returning fuel, a second fuel suction device 8 for drawing fuel stored in the fuel tank 9, and a jet pump portion 7 mounted to the reservoir 4. The reservoir 4 receives the driving means 1 and the first fuel suction device 3 therein, and a check valve 5 is mounted on the bottom surface of the reservoir 4 such that fuel in the fuel tank 9 is supplied to the reservoir 4 through the check valve 5. Furthermore, the fuel from a fuel injector (not shown) is returned to the reservoir 4 through the return pipe 6. The fuel temporarily reserved in the reservoir is sent to the fuel injector by the driving force generated by the driving means 1.

Jet pump portion 7 is connected to the side of the reservoir 4. An inlet of the jet pump portion 7 is connected to the return pipe 6 and the second fuel suction device 8, and the outlet of the jet pump portion is connected to the reservoir 4.

Figure 2:
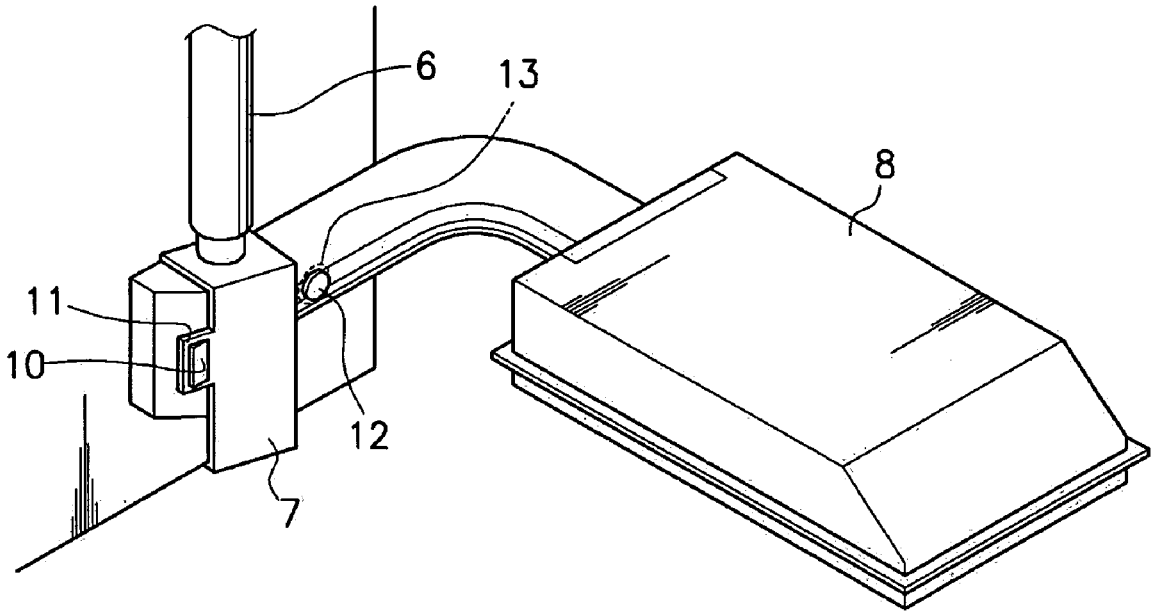
FIG. 2 illustrates a connection between a jet pump portion and a reservoir.
Figure 3:
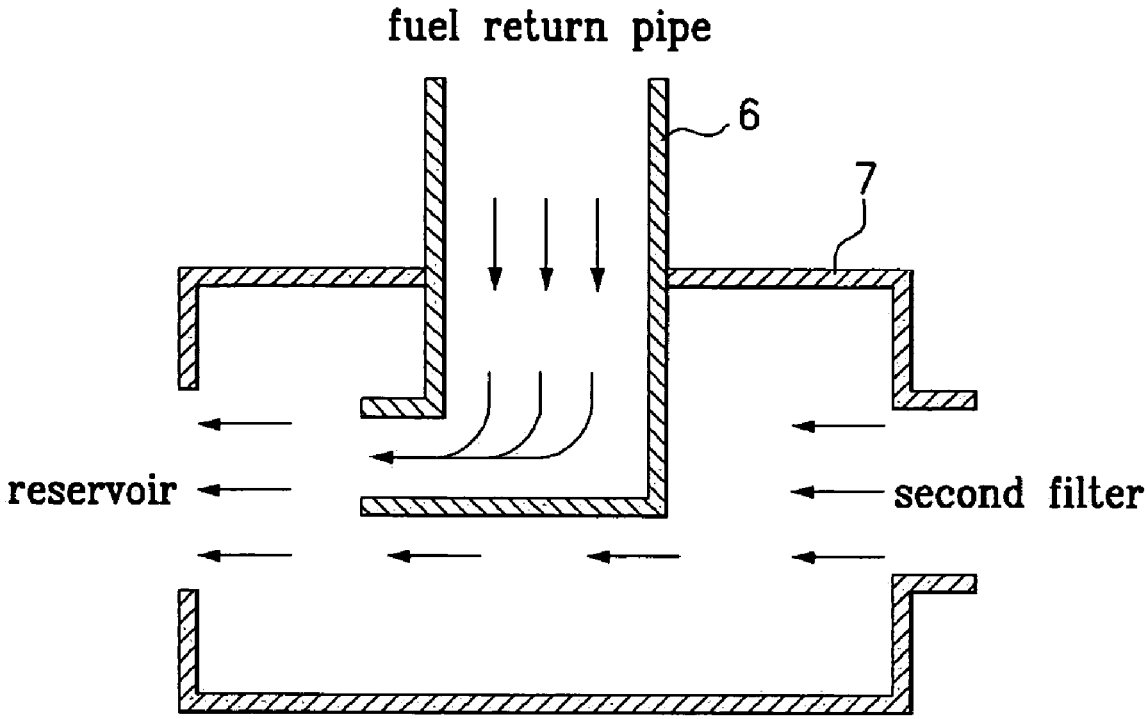
FIG. 3 illustrates a fuel flow in the jet pump portion.

As shown in FIG. 2, a first detent 10 is formed on the reservoir 4 and a hook 11 is formed on the jet pump portion 7. The first detent 10 and the hook 11 are complementarily combined such that the jet pump portion 7 is fixed to the reservoir 4. Furthermore, a second detent 12 is formed on the jet pump portion 7 and a hole 13 is formed on the connecting pipe of the second fuel suction device 8. The second detent 12 and the hole 13 are complementarily combined such the second fuel suction device 8 is fixed to the jet pump portion 7.

Preferably, the connection between the jet pump portion 7 and the second fuel suction device 8 is sealed with thermal fusion for preventing the fuel from permeating through the connection. The jet pump portion 7 has two inlets respectively communicated with the return pipe 6 and the second fuel suction device 8, and one outlet communicated with the reservoir 4.

The second fuel suction device 8 horizontally extends with respect to the fuel tank 9, and the return pipe 6 is fixed to the upper portion of the jet pump portion 7. The second fuel suction device 8 faces the bottom surface of the fuel tank 9 such that when the fuel in the fuel tank 9 is driven to the corner, fuel can still be supplied to the reservoir 9.

As described above, the jet pump portion 7 has two inlets respectively communicating with the return pipe 6 and the second fuel suction device 8, and one outlet communicating with the reservoir 4. Fuel flow from the return pipe 6 and the second fuel suction device 8 passes through the jet pump portion 7 and is supplied to the reservoir 4. The return pipe 6 is connected to the upper portion of the jet pump portion 7 and curved in the direction of the reservoir 4 inside of the jet pump portion.

Accordingly, when the fuel is returned by the fuel return pipe 6 and flows through the jet pump portion 7, the return pipe 6 functions as an orifice such that the fuel in the fuel tank is drawn by the second fuel suction device 8, and is supplied to the fuel reservoir 4 without any additional driving means for the second fuel suction device 8. Specifically, even though the fuel is driven to the corner of the fuel tank 9 such that the fuel can not be supplied to the reservoir 4 through the check valve 5, the fuel driven to the corner is drawn by the second fuel suction device 8 and can be supplied to the fuel reservoir 9.

According to the fuel pump assembly of this invention, when the vehicle moves on an inclined road such that the fuel in the fuel tank is driven to the corner of the fuel tank, fuel supply to the fuel injector can be performed utilizing a second fuel suction device. Furthermore, the suction of the second fuel suction device can be performed without any additional driving means such that the inner structure of the fuel tank becomes simple.

What is claimed is:

1. A fuel pump assembly mounted in a fuel tank for sending fuel to fuel injector, comprising:

a driving means for supplying a driving force for sending or returning fuel;

a reservoir for temporarily reserving fuel from the fuel tank through a check valve mounted on a bottom portion thereof;

a first fuel suction device for drawing fuel reserved in the reservoir;

a return pipe for returning fuel from the fuel injector to the reservoir;

a second fuel suction device for drawing fuel stored in the fuel tank; and a jet pump portion of which an outlet is connected to a bottom portion of the reservoir, wherein the second fuel suction device and a return pipe are connected to an inlet of the jet pump portion, wherein the second fuel suction device extends horizontally outward from the jet pump with respect to the fuel tank.

2. The fuel pump assembly of claim 1, wherein the return pipe functions as an orifice such that the fuel in the fuel tank is drawn into the reservoir through the second fuel suction device.

3. The fuel pump assembly of claim 2, wherein one end of the return pipe, which is connected to the jet pump portion, is bent to the direction of the reservoir.

4. The fuel pump assembly of claim 2, wherein a first detent is formed on the bottom portion of the reservoir and a hook is formed on the jet pump portion such that the jet pump portion is fixed to the reservoir by a connection between the first detent and the hook.

5. The fuel pump assembly of claim 4, wherein a hole is formed on the second fuel suction device and a second detent is formed on the jet pump portion such that the second fuel suction device is fixed to the jet pump portion by connection between the second detent and the hole.

6. The fuel pump assembly of claim 5, wherein the connection between the second fuel suction device and the jet pump portion is sealed with thermal fusion.

* * * * *